US007914221B2

(12) United States Patent
Milesi et al.

(10) Patent No.: US 7,914,221 B2
(45) Date of Patent: Mar. 29, 2011

(54) COSMETIC PRODUCT APPLICATOR OF VARIABLE CONFIGURATION

(75) Inventors: Frederic Milesi, Paris (FR); Fabrice Dieudonat, Fosses (FR)

(73) Assignee: Alcan Packaging Beauty Services (FR)

( * ) Notice: Subject to any disclaimer, the term of this patent is extended or adjusted under 35 U.S.C. 154(b) by 1108 days.

(21) Appl. No.: 11/615,248

(22) Filed: Dec. 22, 2006

(65) Prior Publication Data

US 2007/0172302 A1 Jul. 26, 2007

(30) Foreign Application Priority Data

Dec. 27, 2005 (FR) ..... 05 13368

(51) Int. Cl.
*A46B 11/00* (2006.01)

(52) U.S. Cl. ..... 401/127; 401/126

(58) Field of Classification Search ..... 401/126, 401/127, 129; 132/218, 320; 15/172, 201
See application file for complete search history.

(56) References Cited

U.S. PATENT DOCUMENTS

| | | | | |
|---|---|---|---|---|
| 4,446,880 | A | 5/1984 | Gueret | |
| 4,498,490 | A * | 2/1985 | Seidler | 132/218 |
| 4,869,612 | A * | 9/1989 | Mooney et al. | 401/130 |
| 5,121,763 | A * | 6/1992 | Kingsford | 132/317 |
| 7,467,905 | B2 * | 12/2008 | Habatjou | 401/127 |
| 2005/0217691 | A1 | 10/2005 | Petit | |

FOREIGN PATENT DOCUMENTS

| | | |
|---|---|---|
| EP | 0717944 | 6/1996 |
| EP | 1475013 | 10/2004 |
| EP | 1593320 | 9/2005 |

* cited by examiner

*Primary Examiner* — David J Walczak
(74) *Attorney, Agent, or Firm* — Banner & Witcoff, Ltd.

(57) ABSTRACT

In an embodiment, an applicator includes an external sheath and an internal rod extending through and beyond a first end of the external sheath. A first end of the internal rod may be coupled to a plurality of axial members that extend between the first end of the internal rod and the first end of the external sheath. By actuating a knob coupled to the internal rod, the distance between the first end of the internal rod and the first end of the external sheath may be adjusted. By adjusting the distance, the configuration of the axial members may be adjusted and this adjustment may modify the amount of product that may be stored between the axial members.

24 Claims, 9 Drawing Sheets

COSMETIC PRODUCT APPLICATOR OF VARIABLE CONFIGURATION

CROSS-REFERENCE TO RELATED APPLICATION

This application claims priority to French Application No. 0513368 filed Dec. 27, 2005, which is incorporated herein by reference.

BACKGROUND OF THE INVENTION a) Field of the Invention

The invention concerns the field of applicators for fluid or pasty products, typically applicators of cosmetic products such as mascaras.

b) Description of the Prior Art

A large number of mascara applicators are already known. These applicators, which are designed to cooperate with a container forming a reservoir for mascara, typically comprise:

a) a cap adapted to seal said container and to serve as means for gripping said applicator, b) an axial rod, c) and a brush, said rod being fixedly connected to said cap at one of its ends, and with said brush at the other one of said ends, said brush comprising a metallic twist binding a plurality of bristles.

With respect to said brush, a large number of models of brushes are already known.

Thus, the brushes described in the following French Patents are known: FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 693, FR 2 774 269, FR 2 796 531, FR 2 796 532, FR 2 800 586.

The brushes described in the following U.S. Patents are also known: U.S. Pat. Nos. 4,733,425, 4,861,179, 5,357,987, 5,595,198, 6,241,411, 6,427,700.

On the one hand, in view of the permanent evolution of mascara formulations, there is a need for developing new applicators which can be used to apply these formulations, and which are typically adapted to each now formulation.

On the other hand, for the persons who use these formulae, there is the requirement that they must rely on a wide range of applicators to obtain different effects, for example different loading levels of product to be applied for the applicator, and/or different effects in combing eyelashes.

In addition, there is an increasing requirement to incorporate new technical functions in the applicators, in order to respond to the needs of the persons using them, as well as to be distinct from the "bottom-of-the-line" products for which the production may be shifted to cheap labor countries.

Finally, in the field of cosmetic products, there is a permanent demand for new products, in order for example to customize the products, whether we are concerned with the formulations, the applicators or also wrappings in general, to the extent that replacement of the products becomes an absolute commercial requirement, to the risk of disappearing from the market place.

SUMMARY OF THE INVENTION

According to the invention, the applicator for a fluid or pasty cosmetic product, has an axial direction and comprises an axial rod that is fixedly connected, at its so-called lower end, with an application means provided with means for retention of said cosmetic product, and at its so-called upper end, with means for manually grabbing said applicator.

It is characterized in that:

a) said axial rod is a co-axial rod comprising a central rod and an external sheath, said central rod comprising a rod portion that is coaxial with said external sheath and a so-called free rod portion which is not covered with said central rod, b) said application means comprises a plurality of N axial members providing an inner space there between, wherein N varies from 2 to 8, said axial elements being fixedly connected, at their upper ends, with said external sheath at the bottom end thereof, and at their lower ends, with said rod portion at the bottom end thereof, c) said grabbing means comprises a so-called fixed grabbing portion and a knob which is rotatably fixedly connected to said central rod, a manual rotation of said knob according to an angle $\alpha$ with respect to said fixed portion causing a relative rotation of said lower ends with respect to said upper ends and thus a twist of said axial elements, in such a manner that it is possible for example to modify at will the volume of said inner space and thereby the quantity of said cosmetic product held back by said application means.

Following rotation of said knob, the applicator according to the invention makes it possible to more or less tighten said axial members, and to modify the inner space so as to operate on the quantity of cosmetic product held back in said application means, as well as on the external volume of said application means.

Since said applicator is typically a part of a dispenser comprising a reservoir containing said cosmetic product, for example a mascara, the person using the applicator can operate the knob, either when the applicator acts together with the reservoir, said application means dipping into said cosmetic product, before being removed from the reservoir, said application means then passing through wringer, or once the applicator has been separated from the container, and possibly during make-up.

Thus, the person using the applicator disposes of a means for modifying the applicator all along the make-up, depending on the type of effect it is desired to be obtained.

BRIEF DESCRIPTION OF THE DRAWINGS

All the figures relate to the invention.

For reasons of clearness of the figures, all the elements or members represented in the figures have not been hatched.

FIG. 1*a* is a side view in perspective of the applicator.

FIG. 1*b* is a side view in perspective of the reservoir which is adapted to operate jointly with the applicator in order to constitute the dispenser.

FIG. 1*c* is a side view in perspective of the dispenser in closed position.

FIG. 1*d* is a cross-section of the dispenser along line D-D of FIG. 1*c*.

FIG. 1*e* is an axial cross-section of the dispenser along line E-E of FIG. 1*c*.

FIG. 1*f* is an enlarged view of the part of FIG. 1*e* that is surrounded by a rectangle illustrated in dotted line, indicated by "f".

FIG. 1*g* is an enlarged view of the part of FIG. 1*e* that is surrounded by a rectangle illustrated in dotted line, indicated by "g". On this figure, the upper end of the application means is an upper end that is ratchetly engaged in the lower end of the external sheath.

FIG. 1*h* is a cross-section view in the transverse plane H-H of FIG. 1*g*, which is a plane that is perpendicular to an axial direction, Illustrating the case where the application means comprises three axial members oriented at 120° with respect to the axial direction.

FIG. 2*a* illustrates the case where the radial members are parallel to one another and are offset with respect to the support.

FIG. 2*b* illustrates the case where all the radial members are not parallel to one another.

FIG. 2*c* illustrates the case where the radial elements are parallel to one another and are centrally aligned with respect to the support. On the right portion of FIGS. 2*b* and 2*c*, by way of illustration, two types of projections or sections of radial members, of circular shape or in the shape of an oval, are represented.

FIG. 2*d* corresponds to FIG. 2*c* and is a simplified representation thereof.

FIG. 2*e* is another simplified representation of an axial member showing a curve, as in the case of FIG. 1*g*.

FIGS. 3*a* to 4*b* relate to another embodiment of the invention.

FIG. 3*a* is an axial section of the applicator.

FIGS. 5*a* to 7*c* illustrate various embodiments of application means or of members of applications means, in axial section.

FIG. 5*a* and 5*b* illustrate an embodiment in which said application means constitute a one-piece member comprising said upper collar at its upper end, and said lower collar at its lower end.

FIG. 5*a* illustrates the cooperation of the bottom end of the external sheath with said upper collar through a ratchet engagement and rotary joint operation means and the joint operation of said bottom end of said free rod portion with said lower collar, through a ratchet engagement and rotary cooperation means.

FIG. 7*c* illustrates the bottom part of the co-axial rods, the external sheath comprising an annular part at its bottom end, which is intended to operate jointly with the upper ends.

FIG. 9*a*, which corresponds to FIG. 3*c*, is a front lateral view In perspective.

FIG. 9*b* is an axial cross-section B-B, along the axial direction, of FIG. 9*a*.

FIG. 9*c* is a cross-section C-C, which is perpendicular to the axial direction of FIG. 9*a*.

DESCRIPTION OF PREFERRED EMBODIMENT

Figure 3C:
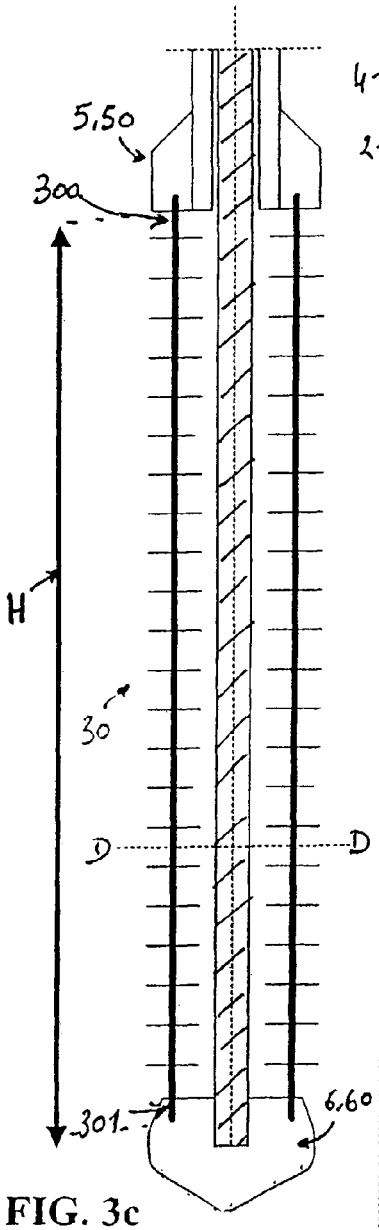
FIG. 3*c* is an enlarged view of the lower part of FIG. 3*a*, surrounded by a rectangle in dotted lines.
Figure 3D:
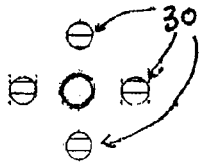
FIG. 3*d* is a cross-section along line D-D of FIG. 3*c* showing the presence of four axial members spaced 90° from one another.

According to the invention, and as illustrated on FIG. 3*c*, the free rod portion 221 can extend to an axial height H which substantially corresponds to the axial height of the application means 3.

As illustrated for example on FIG. 3*c*, the axial members 30 may have at their upper ends 300 a so-called upper connecting means 5.

The upper connecting means 5 may be a so-called upper ring 50 possibly rotatably connected to external sheath 23, at its bottom end 230.

Figure 5A:
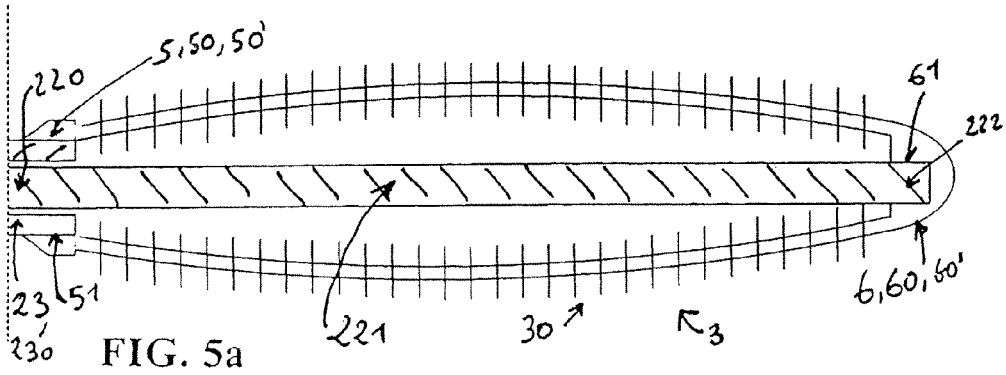
Figure 5B:
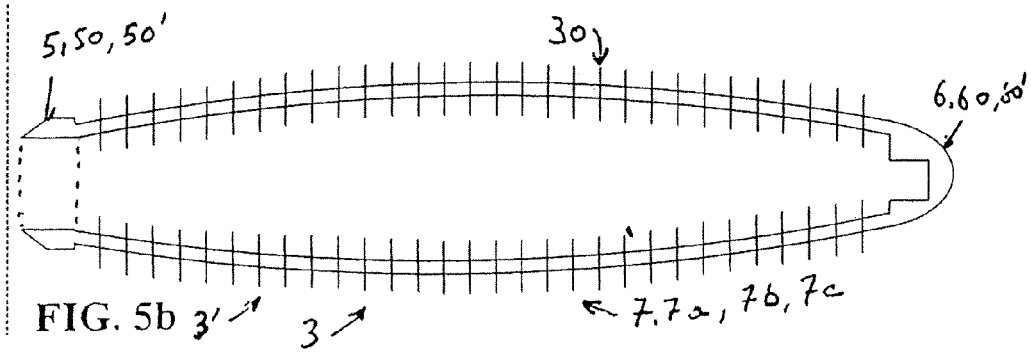

As illustrated for example on FIGS. 5*a* and 5*b*, upper collar 50 may be a collar 50' which constitutes a one-piece molded member of plastic material 7, 7*a* with the plurality of axial members 30, upper collar 50' comprising an axial ratchet engagement means 51 with external sheath 23.

Figure 5C:
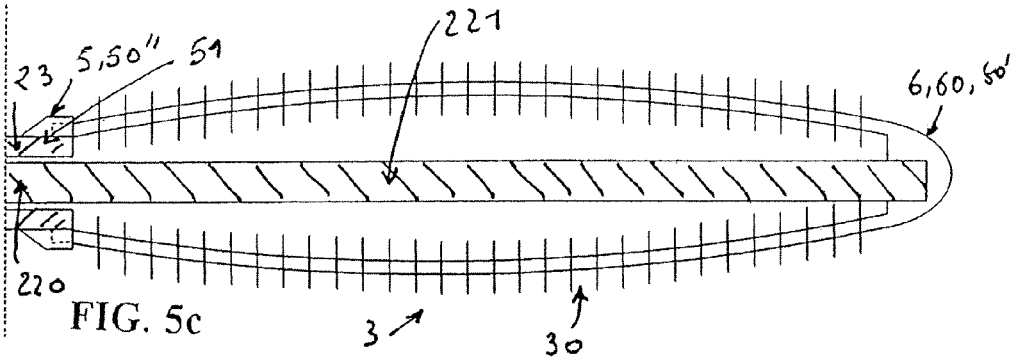
FIGS. 5*c* and 5*d* are respectively similar to FIGS. 5*a* and 5*b*. They differ in that said upper collar is a collar that is distinct from said axial members. In this embodiment, he application means constitute a one-piece member comprising a lower collar at its lower end.
Figure 5D:
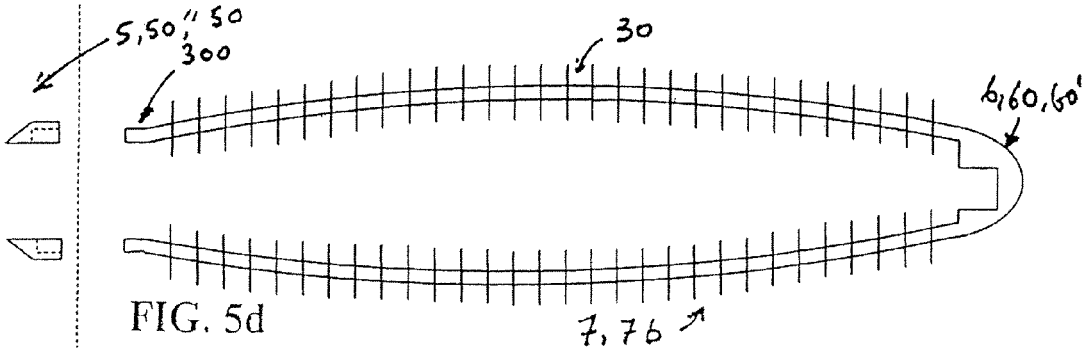

As illustrated in FIGS. 5*c* and 5*d*, the upper collar 50 may be a collar 50" which operates jointly with external sheath 23 at its bottom end 230, in a manner to block the upper ends 300 of the axial members 30 and to rotatably connect the upper ends 300 to the external sheath 23.

As illustrated for example on FIG. 3*c*, the axial members 30 may provide at theirs lower ends 301 a so-called lower connection means 6, so as to rotatably cooperate with the free rod portion 221 at its bottom end 222.

The lower connection means 6 may be a so-called lower collar 60, connected, possibly rotatably, to the free rod portion 221, typically through an axial ratchet engagement means 61.

As illustrated on FIGS. 5*a* and 5*b*, the lower collar 60 may be a collar 60' defining a one-piece molded member of plastic material 7*b* with the plurality of axial members 30.

Figure 6A:
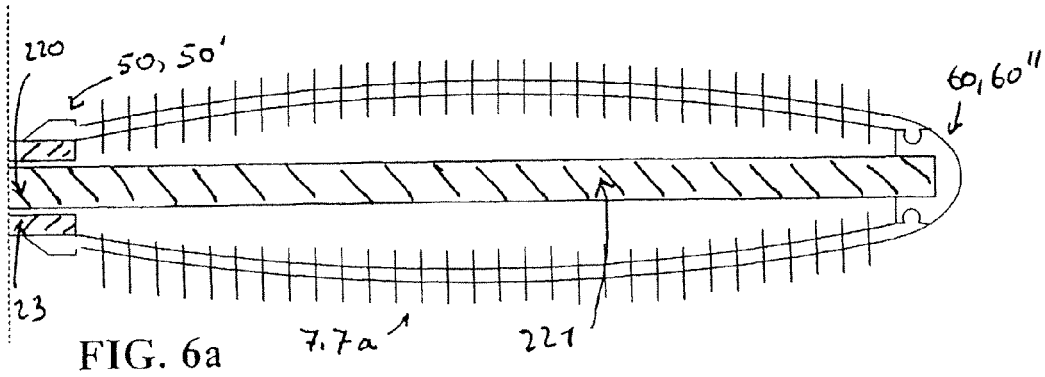
FIGS. 6*a* and 6*b* are respectively similar to FIGS. 5*a* and 5*b*. They differ in that the lower collar is a collar that is distinct from he axial members. In this embodiment, the application means constitutes a one-piece member comprising an upper collar at its upper end.
Figure 6B:
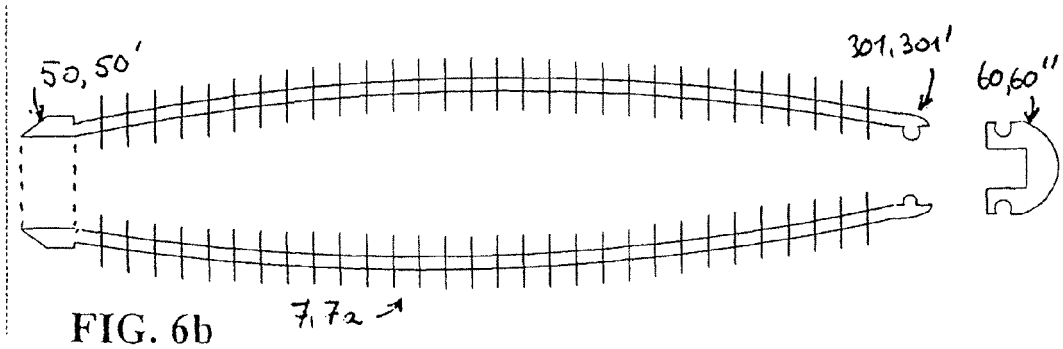

As illustrated on FIGS. 6*a* and 6*b*, the lower collar 60 may be a collar 60" that acts together with the free rod portion 221 at its bottom end 222, in a manner to block the lower ends 301 of the axial members 30 and to rotatably connect lower ends 301 to the free rod portion 221.

On FIGS. 6*a* to 6*d*, the collar 60" acts together with the lower ends 301, 301' through ratchet engagement means.

Figure 7A:
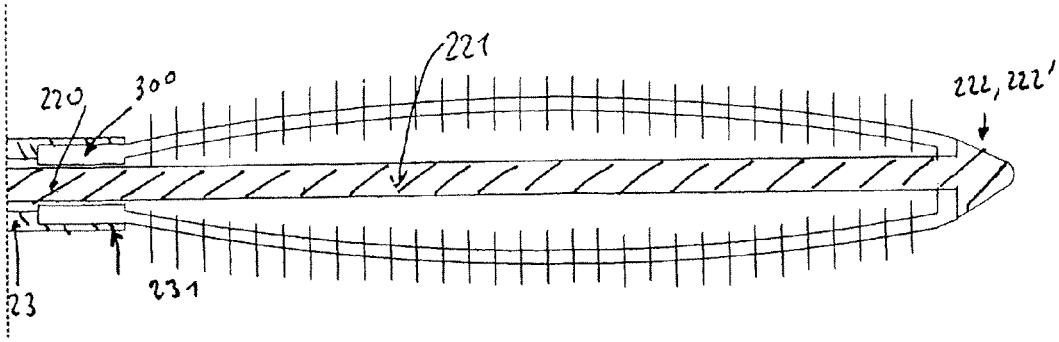
FIGS. 7*a* and 7*b* are respectively similar to FIGS. 5*a* and 5*b*. They substantially correspond to the embodiment of FIG. 1*g*, the free rod portion having a bottom end defining a male part that is ratchetly engaged in the collar constituting a female part. In this embodiment, the application means defines a one-piece member comprising a lower collar at its lower end.
Figure 7B:
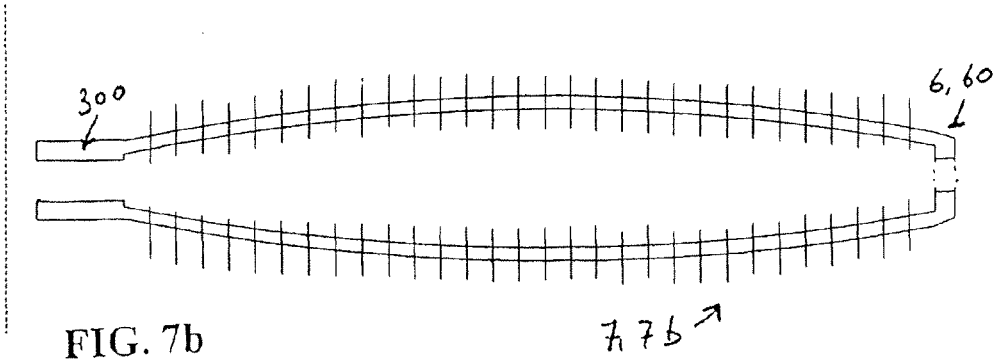
Figure 7C:
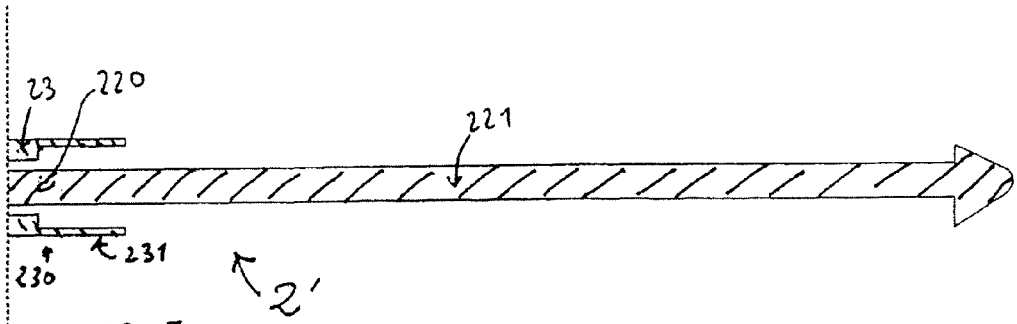
Figure 8A:
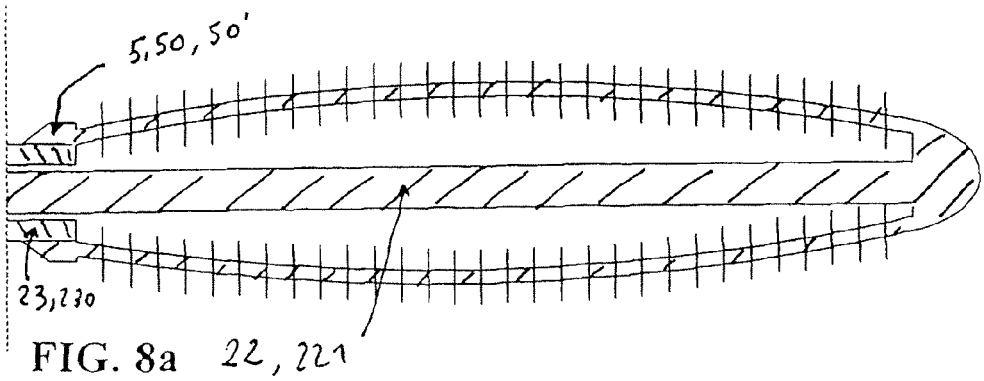
FIGS. 8*a* and 8*b* are respectively similar to FIGS. 5*a* and 5*b*. They differ in that the application means and said central rod constitute a one-piece member.
Figure 8B:
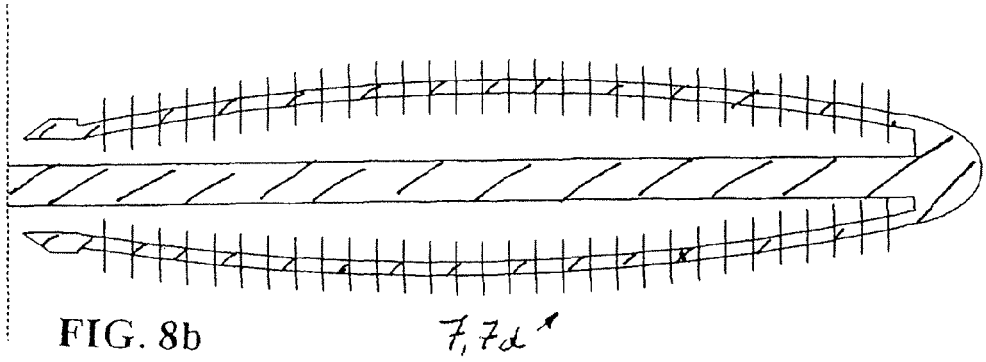
Figure 8C:
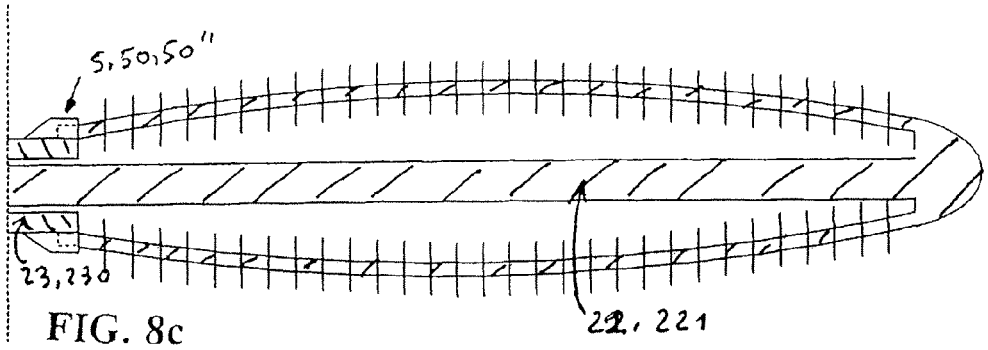
FIGS. 8*c* and 8*d* are respectively similar to FIGS. 5*c* and 5*d*. They differ in that the application means and the central rod constitute a one-piece member.
Figure 8D:
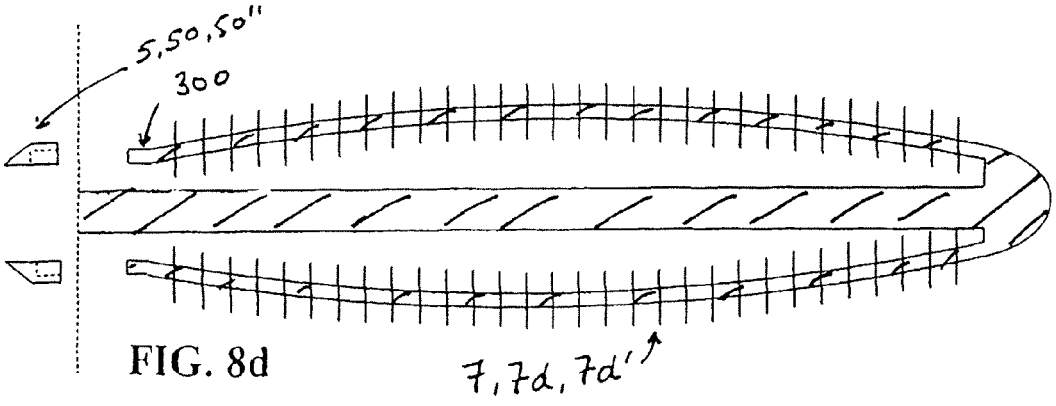

However, according to another variant, the lower collar 60 could also constitute a crown that surrounds the ends 301, in a similar manner to the left part of FIG. 7*a* in which the annular portion 231 operates jointly with the upper ends 300.

As illustrated on FIG. 5*b*, the plurality of axial members 30 may define with upper 50 and lower 60 collars, a one-piece molded member of plastic material 7*c*.

As illustrated on FIGS. 8*a* to 8*d*, the plurality of axial members 30 may constitute a one-piece molded member 7*d*, 7*d'* of plastic material with the free rod portion 221.

Figure 6C:
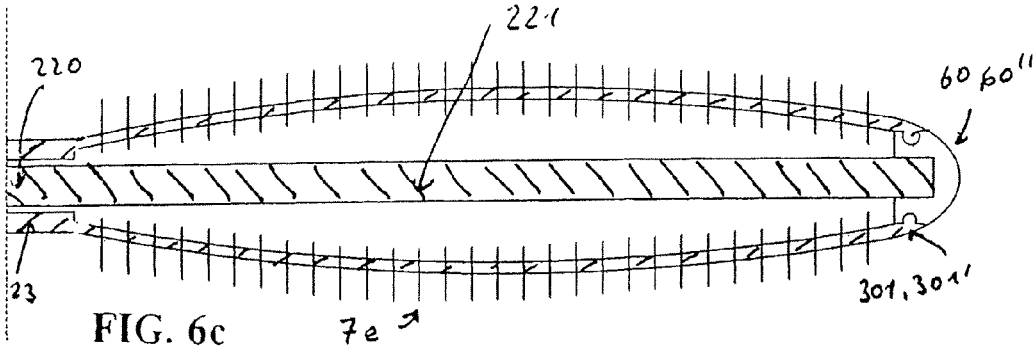
FIGS. 6*c* and 6*d* are respectively similar to FIGS. 6*a* and 6*b*. They differ in that the upper collar is a collar that is distinct from the axial members. In this embodiment, the application means constitutes a one-piece member with the external sheath.
Figure 6D:
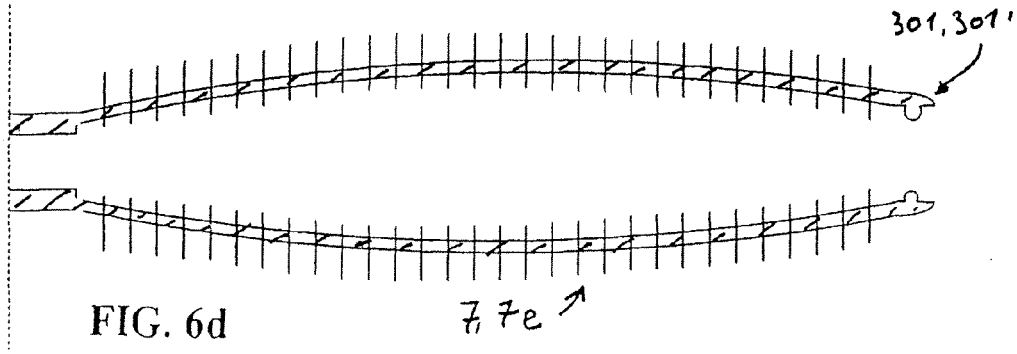

As illustrated on FIGS. 6*c* and 6*d*, the plurality of axial members 30 may, through upper ends 300, define with external sheath 23 a one-piece molded member 7, 7*e* of plastic material.

According to the invention, the rod portion 220 which is coaxial with the external sheath 23, and said free rod portion 221 may typically have a same diameter. However, the rod portion 220 which is coaxial with the external sheath 23 and the free rod portion 221, may not have the same diameter, only rod portion 220 which is coaxial with external sheath 23 being cylindrical, in a manner to allow for said manual rotation.

Figure 1A:
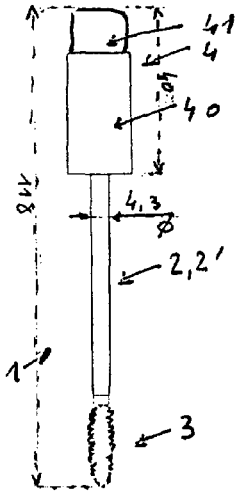
FIGS. 1*a* to 1*h* relate to a first embodiment of the invention.
Figure 1C:
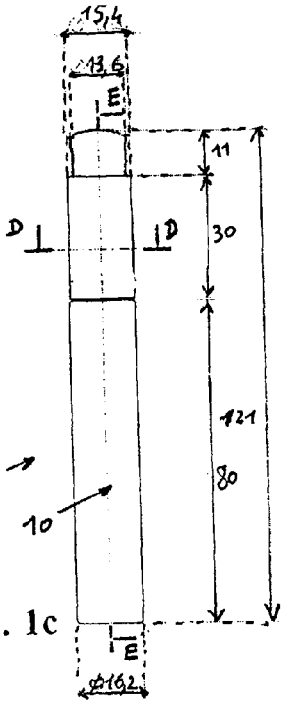
Figure 1D:
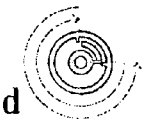
Figure 1F:
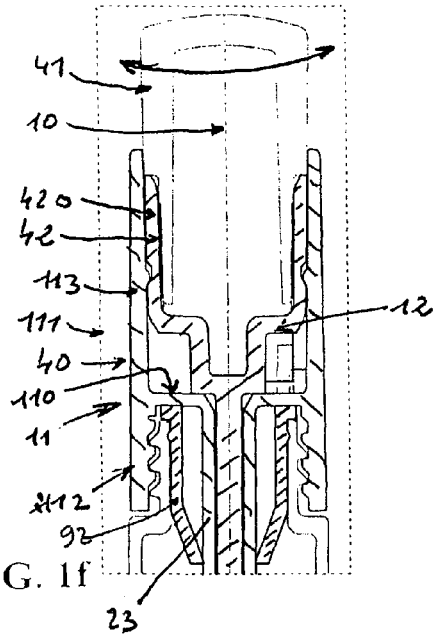
Figure 1B:
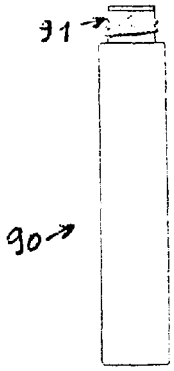
Figure 1E:
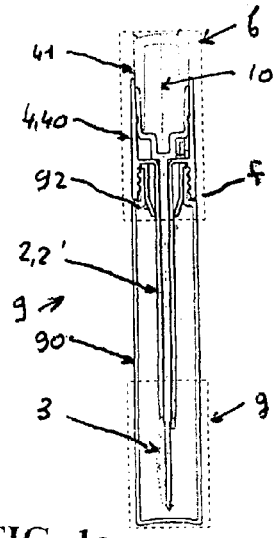
Figure 1G:
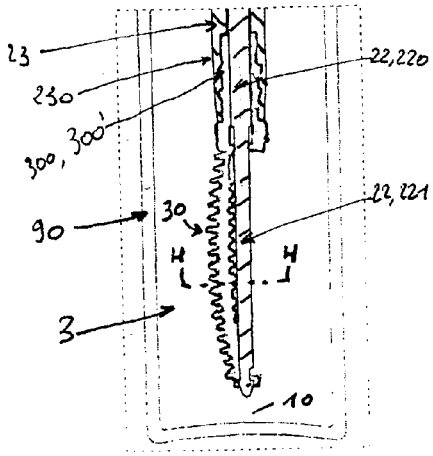
Figure 1H:
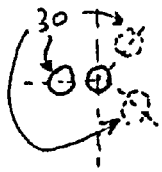
Figure 2A:
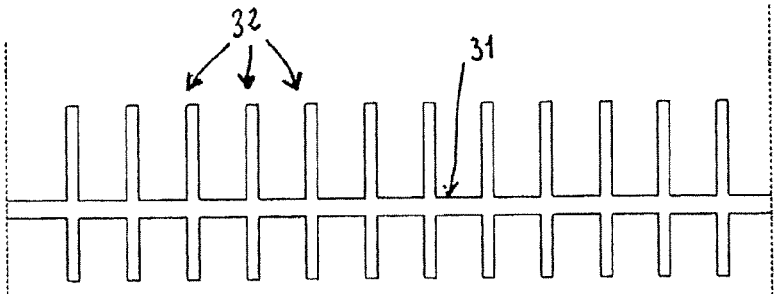
FIGS. 2*a* to 2*e* illustrate various embodiments and representations of axial members formed of a support that fixedly connects a plurality of radial members having a space there between, allowing for a sampling of the product and its later application.
Figure 2B:
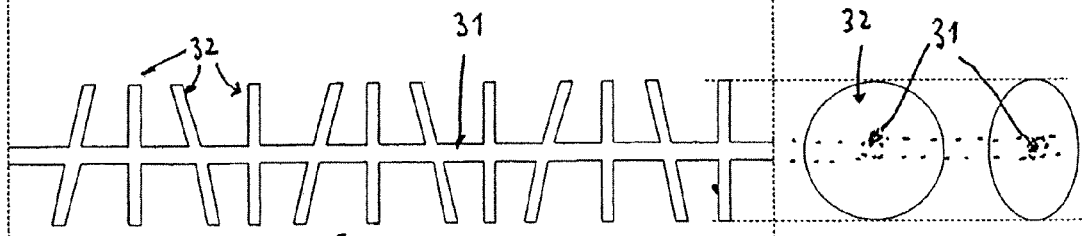
Figure 2C:
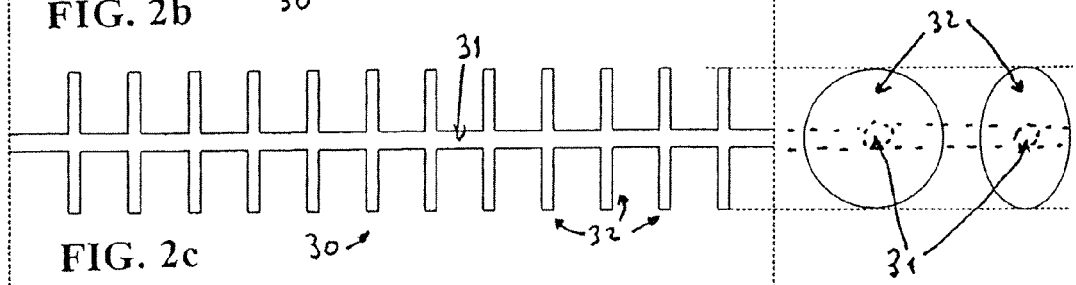
Figure 2D:
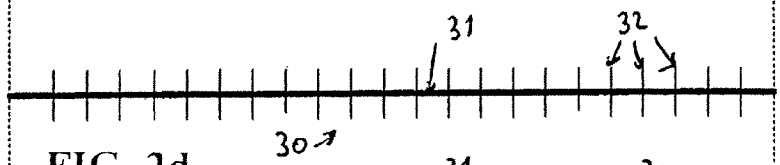
Figure 2E:
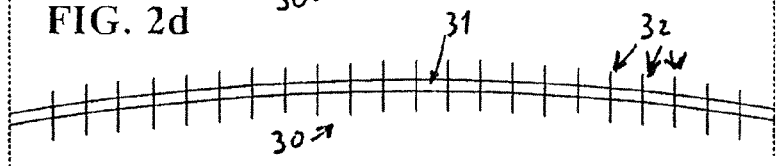

As illustrated in FIG. 1*f*, the fixed part 40 and the external sheath 23 constitute a one-piece member 11 which is molded and is made of plastic material and comprising a horizontal part 110 and a peripheral skirt 111 comprising a lower interiorly threaded part 112 and an upper part 113 that is capable of operating jointly with knob 41 typically by means of a head 42 defining a one-piece member 12 with the central rod 22, the head typically comprising an annular skirt 420 that is coaxial with upper part 113.

According to the invention, knob 4 can operate jointly with fixed part 40 by joint action of a helical ramp and a lug that moves in ramp, said manual rotation of knob 41 by an angle $\alpha$ with respect to the fixed part 40 leading, in addition to the relative rotation of upper ends 300 with respect to lower ends 301, to an axial movement of the central rod 22 with respect to external sheath 23, an angular rotation by an angle+$\alpha$ leading to a forward axial movement which has a tendency to exert an axial tension on the axial members 30, a reverse angular rotation by an angle−$\alpha$ leading to a rearward axial movement tending to exert a compression on the axial members 30. Since this embodiment can easily be deducted from the embodiment represented on FIG. 1*f*, it has not been illustrated on a distinct figure.

As illustrated on FIGS. 2*a* to 2*e*, axial member 30 may comprise an axial support 31 and a plurality of n radial members 32 fixedly connected to axial support 31, wherein n varies from 5 to 30.

The n radial members 32 may be regularly spaced along axial height H. According to the invention, N may vary from 3 to 5.

Figure 3A:
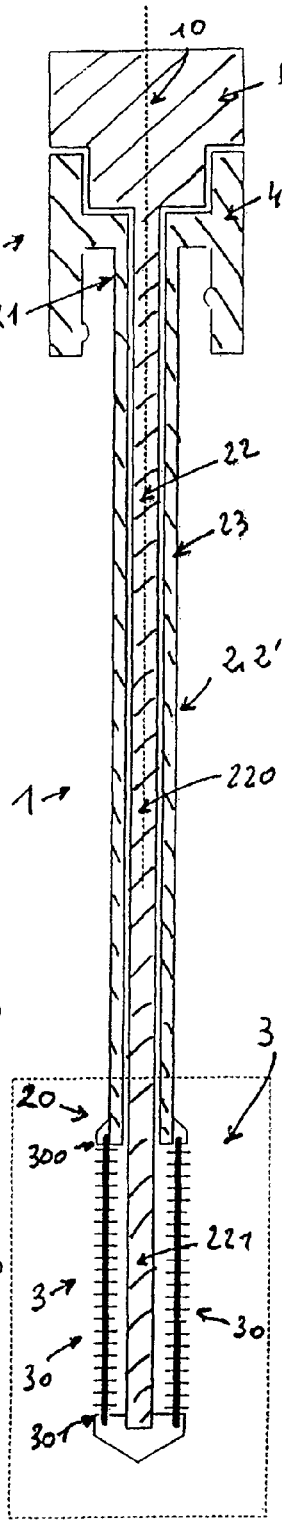
Figure 3B:
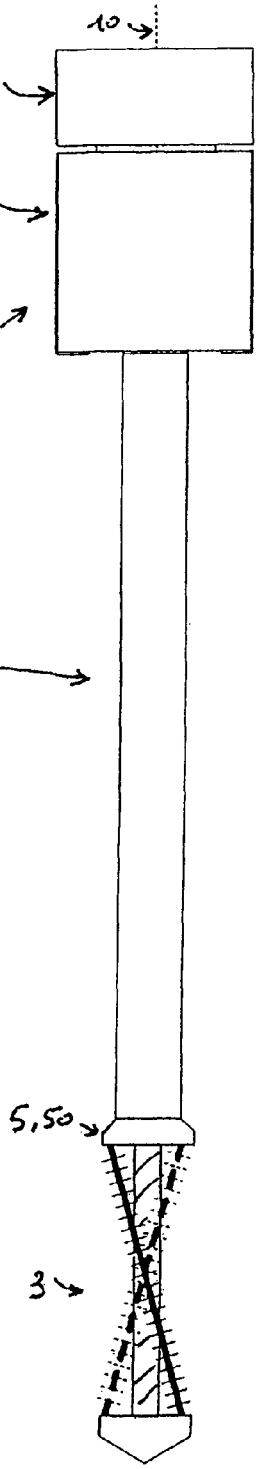
FIG. 3*b* is a side view in perspective which illustrates the torsion of the axial members, two only having been illustrated, one in the front in full line, one in the back in dotted line.

As illustrated on FIGS. 3*a* and 3*c*, the plurality of axial members 30 may, before the rotation, constitute a substantially cylindrical cluster 33 of members that are parallel to one another and substantially parallel to the free rod portion 221 which is not covered with external sheath 23.

As illustrated on FIGS. 5*a* to 8*d*, the plurality of axial members 30 may, before the rotation, constitute a cluster 33' which bulges out at the level of its central part, in the manner of a spindle.

Figure 9A:
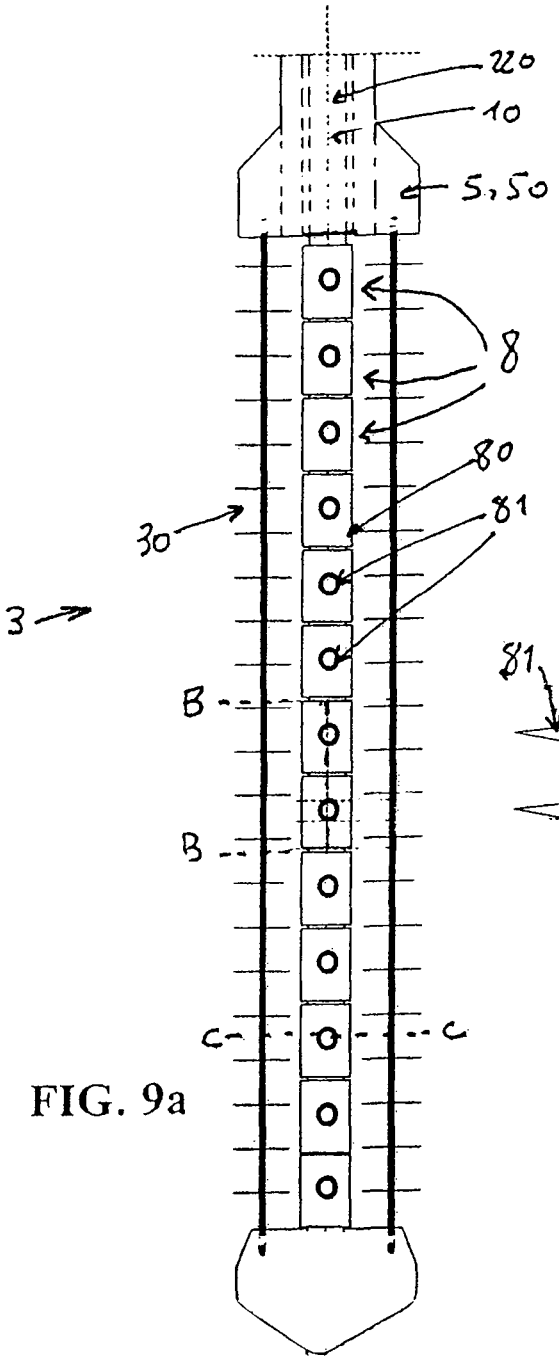
FIGS. 9*a* to 9*c* illustrate an embodiment of application means comprising a plurality of annular members which are fixed to the free rod portion, each annular member comprising an annular part surrounding a portion of the free rod, and a radial part defining a comb tooth.
Figure 9B:
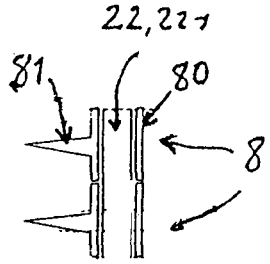
Figure 9C:
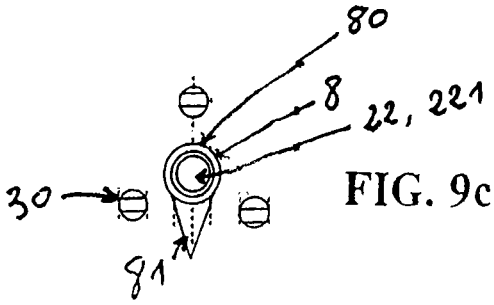

As illustrated on FIGS. 9*a* to 9*c*, the application means 3 may comprise a plurality of annular members 8 which are fixedly connected to the free rod portion 221, the annular members 8 comprising an annular part 80 and a radial part 81 typically defining at least one comb tooth.

Figure 4B:
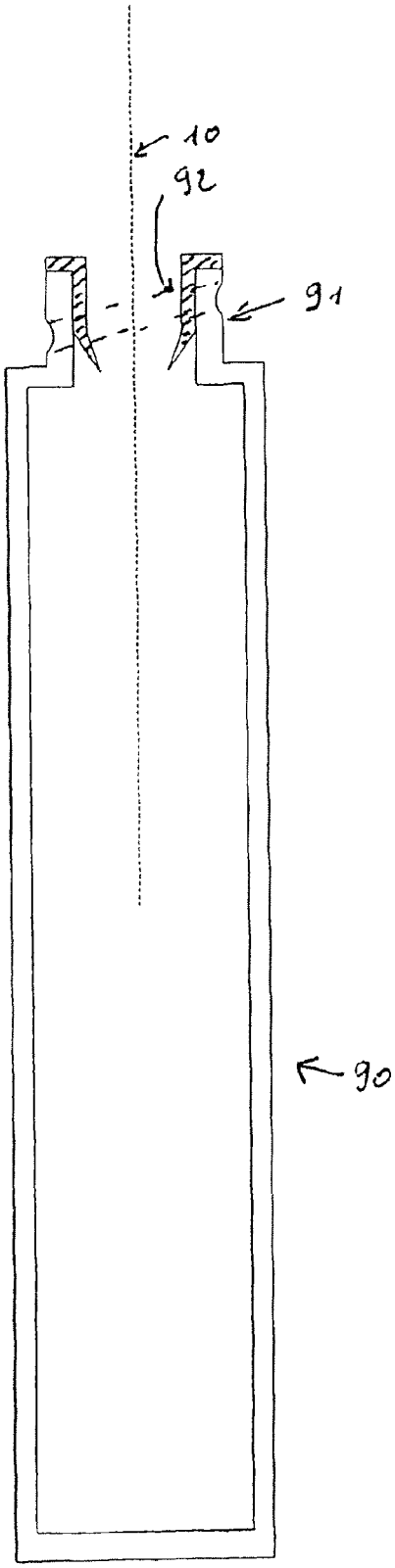
Figure 4A:
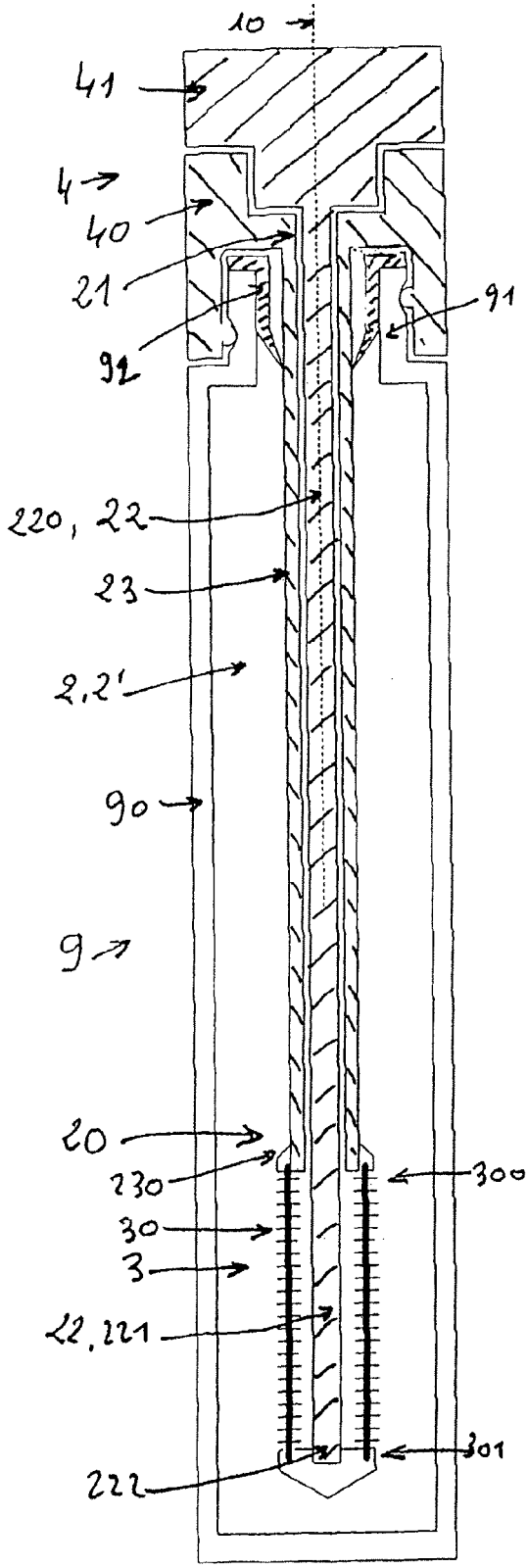
FIG. 4*a* is a cross-section view of the dispenser comprising the applicator of FIG. 3*a* and the reservoir represented in axial section of FIG. 4*b*.

Another object of the invention consists of a dispenser 9 for a cosmetic product comprising a rerservoir 90 which is capable of containing the cosmetic product, typically a mascara, and provided with a threaded neck 91 that operates jointly with the manual gripping means 4 of applicator 1 according to any one of claims 1 to 21, the fixed part 40 of the manual gripping means 4 comprising a thread capable of operating jointly with the threaded neck 91 by screwing/unscrewing, the neck possibly comprising a wringer 92 for the application means 3. Such a dispenser 9 has been illustrated on FIG. 4*a*.

EXAMPLES OF EXECUTION

All the figures constitute examples of execution.

LIST OF REFERENCE MARKS

Applicator . . . 1
- Axial direction . . . 10
- One-piece member 40+23 . . . 11
  - Horizontal part . . . 110
  - Peripheral skirt . . . 111
  - Inwardly threaded part . . . 112
  - Upper part . . . 113

Axial rod of 1 . . . 2

Co-axial rod . . . 2'
- Bottom end . . . 20
- Top end . . . 21
- Central rod . . . 22
  - Rod portion coaxial to 23 . . . 220
  - Free rod portion . . . 221
  - Bottom end of 221 . . . 222
- External sheath . . . 23
  - Bottom end . . . 230

Application means . . . 3
- Axial member . . . 30
  - Upper end . . . 300, 300'
  - Lower end . . . 301
- Axial support of 30 . . . 31
- Radial member . . . 32
- Cluster of 30 . . . 33, 33'

Manual gripping means . . . 4
- Fixed part of 4 . . . 40
- Knob connected to 22 . . . 41
- Head connected to 22 . . . 42
  - Annular skirt connected to 41 . . . 420

Upper connection means of 300 to 23 . . . 5
- Upper collar . . . 50, 50', 50"
- Catch means of 50 & 23 . . . 51

Lower connection means of 301 to 221 . . . 6
- Lower collar . . . . 60, 60'
- Catch means of 60 & 221 . . . 61

One-piece molded member of 3 . . . 7

Upper collar 50 and plurality of 30 . . . 7*a*

Lower collar 60 and plurality of 30 . . . 7*b*

Collars 50 & 60 and plurality of 30 . . . 7*c*

Plurality of 30 & 22 . . . 7*d*, 7*d* "

Annular member fixedly connected to 221 . . . . 8
- Annular part . . . 80
- Radial part defining a comb tooth . . . 81

Dispenser . . . 9
- Container . . . 90
- Neck . . . 91
- Wringer . . . 92

What is claimed is:

1. Applicator (1) for a fluid or pasty cosmetic product having an axial direction (10) and comprising an axial rod (2) fixedly connected at a bottom end (20), to an application means (3) provided with a means for retaining said cosmetic product, and at a top end (21), to a means (4) for manually gripping said applicator (1), characterized in that:

a) said axial rod (2) is a co-axial rod (2') comprising a central rod (22) and an external sheath (23), said central rod (22) comprising a rod portion (220) that is coaxial to said external sheath (23) and a free rod portion (221) which is not covered by said external sheath (23), b) said application means (3) comprises a plurality of N axial members (30) providing therebetween an inner space that can be loaded with a cosmetic product, wherein N varies from 2 to 8, said axial members (30) being fixedly connected, at their upper ends (300), to the bottom end (230) of said external sheath (23), and at their lower ends (301), to the bottom end (222) of said free rod portion (221), c) said manual gripping means (4) comprises a fixed gripping part (40) and a knob (41) that is rotatably fixedly connected to said central rod (22), a manual rotation of said knob (41) by an angle $\alpha$ with respect to said fixed gripping part (40) leading to a relative rotation of said lower ends (301) of said axial members (30) with respect to said upper ends (300), in a manner to constitute a twist, and allowing a modification of the volume of said inner space and thus of a quantity of said cosmetic product held by said application means (3).

2. Applicator according to claim 1 wherein said free rod portion (221) extends along an axial height H that corresponds substantially to the axial height of said application means (3).

3. Applicator according to claim 1 wherein said axial members (30) are provided at their said upper ends (300) with an upper connecting means (5).

4. Applicator according to claim 3 wherein said upper connecting means (5) is an upper collar (50) that is fixedly connected to the bottom end of said external sheath (23).

5. Applicator according to claim 4 wherein said upper collar (50) is a collar (50') constituting a one-piece molded member (7, 7*a*) of plastic material with said plurality of axial members (30), said upper collar (50') comprising an axial means for ratchetly engaging said external sheath (23).

6. Applicator according to claim 5 wherein said plurality of axial members (30) constitutes a one-piece molded member of plastic material (7*c*) with said upper (50) and lower (60) collars.

7. Applicator according to claim 4 wherein said upper collar (50) is a collar (50") that is associated with said external sheath (23) at its bottom end (230), in a manner to block said upper ends (300) of said axial member (30) and to rotatably fixedly connect said upper ends (300) to said external sheath (23).

8. Applicator according to claim 7 wherein said plurality of axial members (30) constitutes a one-piece molded member of plastic material (7*d*, 7*d'*) with said free rod portion (221).

9. Applicator according to claim 1 wherein said axial members (30) are provided at their lower ends (301) with a lower connecting means (6), in a manner to be rotatably associated with said free rod portion (221) at the bottom end (222) thereof.

10. Applicator according to claim 9 wherein said plurality of axial members (30) constitute a one-piece molded member of plastic material (7, 7*e*), with said external sheath (23), through said upper ends (300).

11. Applicator according to claim 9 wherein said lower connecting means (6) is a lower collar (60), that is possibly rotatably, fixedly connected to said free rod portion (221) through an axial ratchet engaging means (61).

12. Applicator according to claim 11 wherein said lower collar (60) is a collar (60') defining a one-piece molded member of plastic material (7*b*) with said plurality of axial members (30).

13. Applicator according to claim 11 wherein said lower collar (60) is a collar (60") that is associated with said free rod portion (221) at the bottom end thereof (222), in a manner to block said lower ends (301) of said axial members (20) and to rotatably fixedly connect said lower ends (301) to said free rod portion (221).

14. Applicator according to claim 1 wherein said rod portion (220) which is coaxial with said external sheath (23) and said free rod portion (221) have a same diameter.

15. Applicator according to claim 1 wherein said rod portion (220) which is coaxial with said external sheath (23) and said free rod portion (221), do not have a same diameter, only said rod portion (220) which is coaxial to said external sheath (23) being cylindrical, so as to allow for said manual rotation.

16. Applicator according to claim 1 wherein said fixed part (40) and said external sheath (23) constitute a one-piece molded member (11) of plastic material comprising a horizontal part (110) and a peripheral skirt (111) comprising a lower interiorly threaded part (112) and an upper part (113) that is adapted to act together with said knob (41).

17. Applicator according to claim 1 wherein said knob (41) operates jointly with said fixed part (40) by cooperation of a helical ramp and a lug that circulates in said ramp, said manual rotation of said knob (41) by an angle $\alpha$ with respect to said fixed part (40), in addition to said relative rotation of said upper ends (300) with respect to said lower ends (301), leading to an axial movement of said central rod (22) with respect to said external sheath (23), an angular rotation of an angle$+\alpha$ leading to a forward axial movement having a tendency to exert an axial tension on said axial members (30), a reverse rotation by an angle$-\alpha$ leading to a backward axial movement which has a tendency to exert a compression on said axial members (30).

18. Applicator according to claim 1 wherein said axial member (30) comprises an axial support (31) and a plurality of n radial elements (32) which are fixedly connected to said axial support (31), wherein n varies from 5 to 30.

19. Applicator according to claim 18 wherein said n radial members (32) are regularly spaced along said axial height H.

20. Applicator according to claim 1 wherein N varies from 3 to 5.

21. Applicator according to claim 1 wherein said plurality of axial members (30), before said rotation, constitute a substantially cylindrical cluster (33) of members that are parallel to one another and are substantially parallel to said free rod portion (221) which is not covered by said external sheath (23).

22. Applicator according to claim 1 wherein said plurality of axial members (30), before said rotation, constitute a cluster (33') which bulges out at its central part, in the manner of a spindle.

23. Applicator according to claim 1 wherein said application means (3) comprises a plurality of annular members (8) which are fixedly connected to said free rod portion (221), said annular members (8) comprising an annular part (80) and a radial part (81) defining at least one comb tooth.

24. A combination of an applicator and a dispenser (9) for a cosmetic product comprising a reservoir (90) that is adapted to contain said cosmetic product, and provided with a threaded neck (91) that is operatively associated with said manual gripping means (4) of said applicator (1) according to claim 1, said fixed part (40) of said manual gripping means (4) comprising a thread that is adapted to be operatively associated with said threaded neck (91) by screwing/unscrewing.

* * * * *